US007088324B2

(12) United States Patent
Sakaguchi et al.

(10) Patent No.: US 7,088,324 B2
(45) Date of Patent: Aug. 8, 2006

(54) LIQUID CRYSTAL DISPLAY DRIVER AND METHOD THEREOF

(75) Inventors: Yoshitami Sakaguchi, Hadano (JP); Katsuyuki Sakuma, Yamato (JP)

(73) Assignee: International Business Machines Corporation, Armonk, NY (US)

( * ) Notice: Subject to any disclaimer, the term of this patent is extended or adjusted under 35 U.S.C. 154(b) by 482 days.

(21) Appl. No.: 10/063,788

(22) Filed: May 13, 2002

(65) Prior Publication Data

US 2002/0171614 A1 Nov. 21, 2002

(30) Foreign Application Priority Data

May 15, 2001 (JP) ..... 2001-145686

(51) Int. Cl.
*G09G 3/36* (2006.01)
*G09G 5/10* (2006.01)

(52) U.S. Cl. ..... 345/87; 345/89; 345/94; 345/690; 345/691

(58) Field of Classification Search ..... 345/87–102, 345/690–693, 589, 204–215
See application file for complete search history.

(56) References Cited

U.S. PATENT DOCUMENTS 5,528,339 A * 6/1996 Buhr et al. ..... 355/32
5,929,835 A * 7/1999 Sakamoto ..... 345/589
6,335,716 B1 * 1/2002 Yamazaki et al. ..... 345/92
6,597,371 B1 * 7/2003 Mandl ..... 345/691
6,806,861 B1 * 10/2004 Sakaguchi et al. ..... 345/100

* cited by examiner

*Primary Examiner*—Vijay Shankar
(74) *Attorney, Agent, or Firm*—Gibb I.P. Law Firm, LLC; Eustus D. Nelson, Esq.

(57) ABSTRACT

JP920010105US125 A liquid crystal display driver for applying a voltage to liquid crystal cells forming an image display area includes a pulse generation circuit for generating a plurality of reference pulses in which pulse generation densities are weighted, a pulse select/synthesis circuit for generating a pulse string by selecting and synthesizing necessary reference pulses on the basis of digital input data and the reference pulses and an integration circuit (low pass filter) for integrating the pulse string generated by the pulse select/synthesis circuit to output an analog voltage for gamma correction.

18 Claims, 16 Drawing Sheets

Configuration for gamma reference voltage generation circuit for LCD source driver Configuration for gamma reference voltage generation circuit for LCD source driver Details of pulse generation circuit and synthesis circuit for n − bit DAC Relationship between the number of divided bits and maximum frequencies of pulse strings when utilizing a pulse generation circuit and pulse synthesis circuit for n – bit DAC

| Number of divided bits | Maximum frequency of pulse string (Hz) | Ratio of constant switching frequency range to whole input data | Remarks |
|---|---|---|---|
| W = 1 | f | 0 | PDM |
| W = 2 | f/2 | 1/2 | Minimum circuit scale |
| W = 3 | f/4 | 3/4 | |
| W = 4 | f/8 | 7/8 | |
| W = 5 | f/16 | 15/16 | |
| ..... | ..... | ..... | |
| W = n | $f/2^{n-1}$ | 1 | PWM |

* Note : Assuming digital input data is n bit

Fig. 4

Typical configuration of pulse generation circuit for PDM type DAC

Example pulse for PDM type DAC

Relationship between digital input data and pulse string frequency for pulse generation circuit Example pulse for PDM type DAC of the invention Comparison of number of gates between 4 clock unit and 8 clock unit

| | 4Clock | 8Clock |
|---|---|---|
| Counter section | | |
| Latch | 17 | 15 |
| 2 – input AND | 8 | 6 |
| Pulse synthesis section (1 Set) | | |
| 2 – input AND | 9 | 13 |
| 3 – input OR | 4 | 5 |
| Pulse synthesis section (10 Sets) | | |
| 2 – input AND | 90 | 130 |
| 3 – input OR | 40 | 50 |

Fig. 12

Configuration of PDM type DAC

Configuration of pulse generation circuit for PDM type DAC

Example pulse for PDM type DAC

Pulse string frequency corresponding to each data

LIQUID CRYSTAL DISPLAY DRIVER AND METHOD THEREOF

BACKGROUND OF THE INVENTION

1. Field of the Invention

The present invention relates to a liquid crystal display and pulse generation circuit for displaying images on the basis of input video signals, and more particularly to a liquid crystal display and pulse generation circuit in which the number of switching times for pulse strings is improved.

2. Background of the Invention

In general, when an image is displayed on a liquid crystal display (LCD), image signals are output from a graphics controller in a system unit or system part of a PC or the like via a video interface. An LCD controller LSI, which receives these image signals, supplies signals to each IC in a source driver (i.e., X driver, LCD driver) and gate driver (i.e., Y driver), and then a voltage is applied to each source electrode and each gate electrode in a TFT array arranged in a matrix fashion, thereby leading to displaying images.

As a configuration employed in this LCD source driver, technologies called chip-on-glass (COG) and wiring-on-array (WOA) have recently become the focus of attention. Also, a technology is being developed where a driver LSI is arranged in a TCP (tape carrier package) and connected to the TFT array substrate (glass substrate) via the TCP. It is expected that manufactures' costs will be reduced by applying these technologies to attach ICs directly on the glass substrate or via the TCP as well as to eliminate wiring on a printed circuit board.

On the other hand, there are mainly two types of digital-analog conversion circuits (DAC): one is a current summing scheme such as an R-2R ladder network type DAC in which there are provided as many current sources as the number of bits of digital input data, wherein the current is added depending on a value of each bit of the input data in order to obtain an output current corresponding to the input data; the other is a time control scheme such as an integral type DAC in which an output voltage is obtained by charging a capacitor for a time depending on the digital input data with a constant current. Furthermore, the time control scheme includes a pulse width modulation (PWM) type DAC in which an output voltage is obtained by integrating a pulse string whose duty is adjusted depending on the digital input data, and a pulse density modulation (PDM) type DAC in which an output voltage is obtained by integrating a pulse string wherein the number of pulses occurring within a predetermined time is adjusted depending on the digital input data.

In order to implement a reference voltage generation circuit for gamma correction that is built in the LCD source driver, in order to reduce the deviation of the reference voltage between drivers, these PWM or PDM type DACs are used. These DACs have a high applicability to LCDs since they are of the above-mentioned time control scheme, wherein a difference of the output voltage is unlikely to be introduced due to dispersion of resistors and capacitors created in the chip.

FIG. 13 depicts a configuration of a typical PDM type DAC. The PDM type DAC comprises a pulse generation circuit 201 for generating a plurality of reference pulses in which pulse generation densities are weighted, a digital input data latch 202 for storing digital input data, a pulse select/synthesis circuit 203 for generating a pulse string by selecting and synthesizing necessary reference pulses on the basis of generated reference pulses and input data, a voltage conversion circuit 204 for converting a pulse string generated by a digital power supply into a desired analog voltage range, and an integration circuit (low pass filter) 205 for converting a pulse string into an analog voltage.

For a PDM type DAC as shown in FIG. 13, since a frequency of the pulse string is able to be increased compared with a PWM type DAC, resistors and capacitors used in integration circuit 205 are reduced, which preferably makes a chip area small, thereby saving costs. On the contrary, power consumption is increased due to the increase of frequency of the pulse string, and moreover the linearity of the output voltage is deteriorated because the number of switching times differs for pulse strings corresponding to each of digital input data.

FIG. 14 depicts a schematic diagram of pulse generation circuit 201 for use in a PDM type DAC for liquid crystal displays. The circuit shown in FIG. 14 is used in the case of 9 bit DAC, which comprises a 9 bit binary counter 210, a 9 bit latch 211, and nine 2-input AND gates 212. By ANDing counter outputs from binary counter 210 with negative latched outputs from 9 bit latch 211, weighted pulses are generated at the reference pulse outputs X8 through X0. Assuming the pulse density of X0 is 1, those of X1, X2, X3, X4, X5, X6, X7 and X8 are 2, 4, 8, 16, 32, 64, 128, 256, respectively. It is also noted that since the reference pulses X0 through X8 are generated such that they become high exclusively, these pulses never overlap temporally each other even if any plural number of reference pulses are synthesized.

FIG. 15 depicts a waveform of pulse outputs (X8 through X5) of a PDM type DAC. Also shown in FIG. 15 are the outputs (B0 through B3) of binary counter 210 and outputs (L0 through L3) of 9-bit latch 211. For example, ANDing a counter output B1 with an inverted latch output L1 produces a pulse output X7 at the rising edge of a counter output B1. In this manner, pulse outputs (X8 through X0) are obtained. In the PDM type DAC, pulse select/synthesis circuit 203 selects pulse outputs X8 through X0 depending on the value of each of the bits of digital input data and then ORs them for the purpose of synthesis to generate a pulse string corresponding to the digital input data. For example, when digital input data is 320 (B101000000), reference pulses X8 and X6 are selected because their corresponding bits in the input data are 1, and then a pulse string is generated by synthesizing X8 and X6, and then sent to voltage conversion circuit 204 where its voltage is converted, and finally being input to integration circuit 205.

FIG. 16 is a diagram illustrating a relationship between each digital input data and its corresponding frequency of the pulse string for a PDM type DAC for liquid crystal displays. It is noted that the operating frequency (i.e., clock input) of a counter and latch is 120 MHz. As is seen from FIG. 16, as digital input data increases from 0 to 256, the frequency of the pulse string also increases monotonously, wherein it reaches a maximum frequency of 60 MHz when the input data is 256, while as digital input data increases from 256 to 511, the frequency of the pulse string decreases monotonously. In this manner, since the frequency of the pulse string varies depending on digital input data (i.e., the number of switching times of a circuit for driving integration circuit 205 behind also varies), a degree of influence of switching upon the analog output voltage varies for each digital input data. This deteriorates the linearity of analog output voltage for DACs. Moreover, if the values of resistors and capacitors used for integration circuit 205 are set to match with pulse strings with low frequencies (i.e., around 0 or 511 of digital input data), the frequency of pulse strings becomes too high around a medium value (256) of the digital input data, resulting in unwanted power consumption.

SUMMARY OF INVENTION

In view of the technical problems described above, a feature of the present invention is to suppress adverse effects upon an analog output voltage due to switching depending on digital input data.

Another feature of the invention is to suppress unwanted power consumption resulting from the number of switching times.

According to the present invention, the number of switching times for pulse strings generated is configured to be smooth and constant without a local peak with respect to digital input data. Namely, the present invention provides a liquid crystal display that includes a liquid crystal cells forming an image display area on a substrate and a driver for applying a voltage to the liquid crystal cells based on a reference voltage for gamma correction corresponding to digital input data. The driver, which is mounted on the substrate and is comprised of a plurality of driver ICs connected via signal lines, keeps the number of switching times for pulse strings per time unit constant for a predetermined range of the digital input data when generating the pulse strings with pulse densities corresponding to the digital input data.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 1 is a schematic diagram illustrating an embodiment of an image display unit the present invention is applied to.

FIG. 4 is a table illustrating a relationship between the number of divided bits and maximum frequencies of pulse strings when utilizing a pulse generation circuit and pulse select/synthesis circuits of the present invention.

FIG. 12 is a table comparing the size of pulse generation circuits between 4 clock unit and 8 clock unit.

DETAILED DESCRIPTION

Figure 1:
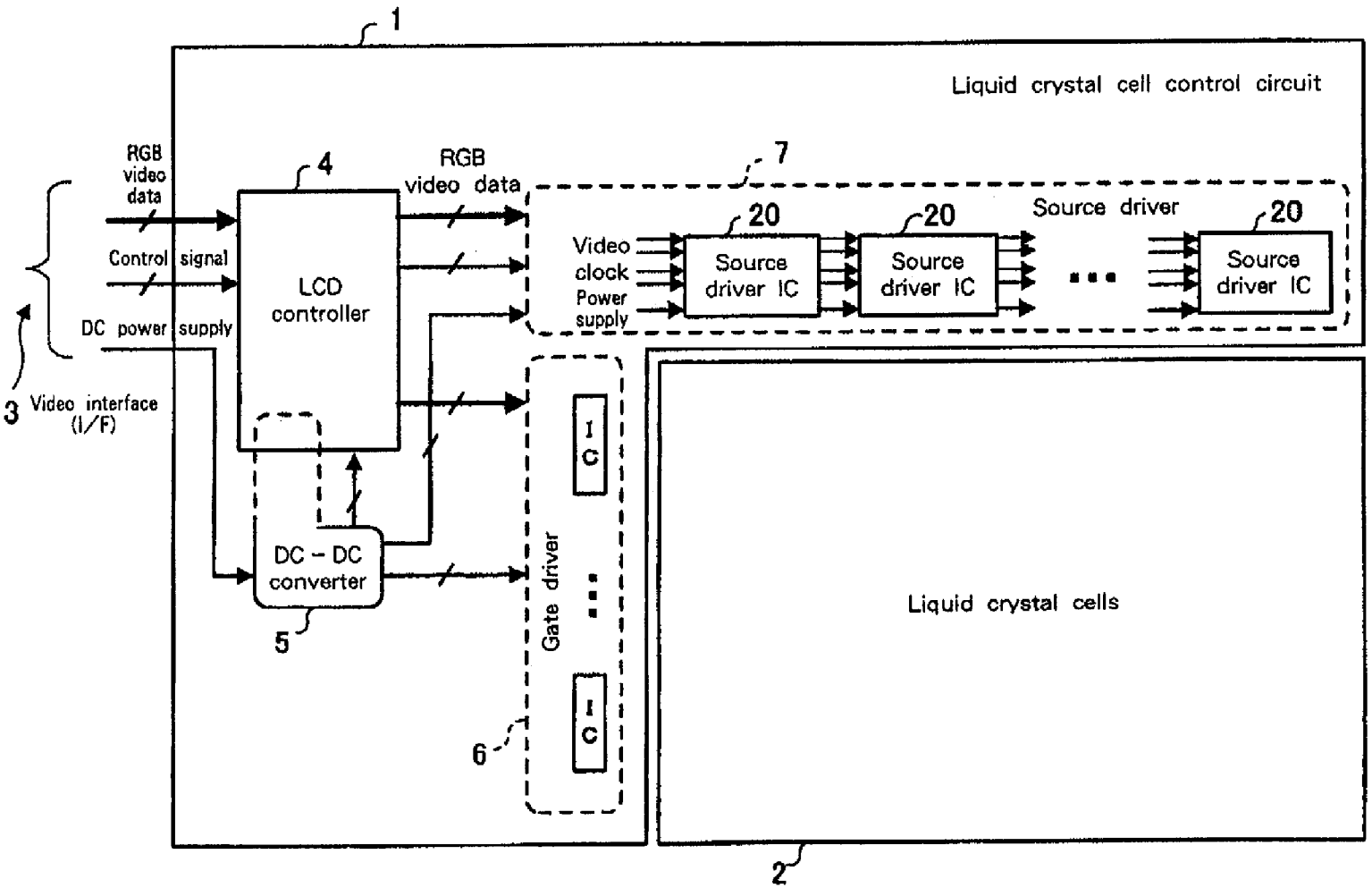

The predetermined range of digital input data may be, for example, the digital input data ranging from 128 to 384 given a 9-bit digital-analog conversion circuit. Such a predetermined range may vary depending on the number of divided bits (W).

In another aspect of the invention, there is provided a driver for use in a liquid crystal display, that is characterized by having no local peak in the number of switching times for pulse strings per time unit when generating the pulse strings with pulse densities corresponding to the digital input data.

In a further aspect of the invention, there is provided a driver for use in a liquid crystal display, that is characterized by obtaining a reference voltage for gamma correction using pulse density modulation (PDM) as well as obtaining an output voltage using pulse width modulation (PWM) for a predetermined range of the digital input data around a medium value when generating pulse strings corresponding to the digital input data.

In a yet further aspect of the invention, there is provided a liquid crystal display driver such as a source driver for LCDs. In other words, the present invention provides a liquid crystal display driver for applying a voltage to liquid crystal cells forming an image display area, the driver includes a pulse generation circuit for generating a plurality of reference pulses in which pulse generation densities are weighted, a pulse select/synthesis circuit for generating a pulse string by selecting and synthesizing necessary reference pulses on the basis of digital input data and the reference pulses, and an integration circuit for integrating the pulse string generated by the pulse select/synthesis circuit to output a voltage (analog voltage) for gamma correction. The number of switching times for the pulse string per time unit is unchanged for a predetermined range of the digital input data for gamma correction.

The pulse select/synthesis circuit outputs a logical sum between a carry output from an adder circuit, which has as its inputs high order W bits of the digital input data of n bits and low order W bits of a binary counter, and a logical product between outputs X(m−1) through X(0) of the pulse generation circuit where m=n−W and the digital input data D(m−1) through D(0), thereby improving linearity for a wide range of input data such as when the number of divided bits is more than and equal to 3.

Furthermore, assuming that the digital input data is n bits and the number of divided bits is W, the pulse generation circuit outputs the reference pulses using an n-bit binary counter, an n−W bit latch, and n−W 2-input gates. However, when W=2, an n−1 bit latch and 2-input gates are required, while no adder (carry detection circuit) is needed.

In a still further aspect of the invention, there is provided a reference pulse generation circuit for generating reference pulses corresponding to n-bit digital input data includes a n-bit binary counter for counting up in synchronization with an input clock, a n−W bit latch for generating signals by delaying high order n−W bits output B (n−1) through B(W) from the binary counter by one input clock period, and n−W logical circuits for performing logical operations with receiving as inputs the high order n−W bits output B(n−1) through B(W) from the binary counter and the delayed signals corresponding to the high order n−W bits output B(n−1) through B(W) from the n−W bit latch and obtaining outputs X(0) through X(n−W−1) with lower reference pulse densities, whereas outputs X(n−W) through X(n−1) are obtained bypassing the logical circuits.

It is noted that when W=2, n−1 logical circuits are either n−1 AND circuits or n−2 AND circuits outputting X(0) through X(n−3) and a NOR circuit outputting X(n−2).

In a further aspect of the invention, there is provided a reference pulse generation circuit for digital-analog conversion employing a pulse density modulation scheme includes means for generating reference pulses that are exclusively in a high state corresponding to digital input data, and means for generating the reference pulses such that a number of switching times for pulse strings per time unit is constant for a predetermined range of the digital input data. It is noted that when W=2, the reference pulses are generated with the frequency thereof being kept constant for half the whole range of the digital input data. Generally speaking, the frequency is kept constant according to the ratio, that is, (2w−1−1)/2w−1 with respect to the whole digital input data.

In another aspect of the invention, there is provided a method for generating reference pulses in a digital-analog converter includes the steps of generating pulse strings with pulse densities corresponding to digital input data that is input to the digital-analog converter, and keeping a number of switching times for the pulse strings per time unit constant for a predetermined range of the digital input data around a medium value. According to this, a maximum frequency of the pulse strings is reduced to less than half of that in the case where the number of switching times is not kept constant.

In a further aspect of the invention, there is provided a method for providing an analog voltage output used for a reference voltage for gamma correction in a source driver for a liquid crystal display includes the steps of for a range of the digital input data excluding a predetermined range around a medium value, integrating a pulse string, whose number of pulses is adjusted depending on the digital input data, to output an analog voltage; and for the predetermined range of the digital input data, integrating a pulse string, whose duty is adjusted depending on the digital input data, to output an analog voltage.

Now the present invention will be described with reference to the accompanying drawings illustrating preferred embodiments thereof.

FIG. 1 is a schematic diagram illustrating an embodiment of an image display unit the present invention is applied to. In the image display unit shown in FIG. 1, a liquid crystal module (LCD panel) is comprised of a liquid crystal cell control circuit 1 and liquid crystal cells 2 in a thin film transistor (TFT) structure. This liquid crystal module may be configured as a display unit separate from a host system such as a personal computer (PC) or as a display of a notebook PC. In liquid crystal cell control circuit 1, RGB video data (i.e., video signals) and control signals are input to an LCD controller 4 via a video interface (I/F) 3 from a graphics controller LSI (not shown) in the system. In general, DC power supply is also supplied through the video I/F 3.

DC-DC converter 5 generates a variety of DC power supply voltages necessary for liquid crystal cell control circuit 1 from DC power supply being supplied, and supplies them to a gate driver 6, a source driver 7 and a fluorescent tube for backlight (not shown), etc. LCD controller 4 processes signals received from video I/F 3 and supplies processed signals to gate driver 6 and source driver 7. Source driver 7 is responsible to supply a voltage to each of the source electrodes of TFTs arranged in a horizontal direction (X direction) in a TFT array, which is arranged in a matrix fashion on liquid crystal cells 2. Gate driver 6 is responsible to supply a voltage to each of the gate electrodes arranged in a vertical direction (Y direction) in a TFT array.

Both gate driver 6 and source driver 7 are comprised of multiple ICs. In the present embodiment, source driver 7 includes multiple source driver ICs 20 made of LSI chips. For convenience of explanation, liquid crystal cell control circuit 1 and liquid crystal cells 2 are shown to be divided in FIG. 1, however, multiple source driver ICs 20 are formed in the COG structure on a glass substrate where liquid crystal cells 2 are made, and furthermore each wiring is also made on the glass substrate in the WOA structure, according to the embodiment of the present invention.

In this manner, particularly for LCDs for a frame with narrow rims around a display area, the cost of LCD panel is reduced by mounting source driver 7 directly on the TFT glass substrate of the LCD panel and implementing wiring between source drivers ICs 20 using aluminum wiring on the glass substrate. Since a sufficient wiring area could not be reserved for such LCD panels, there may be a case where a reference voltage for gamma correction, which would be typically generated on an LCD panel board (PCB), is produced in individual source driver ICs 20. In this case, a high-precision digital-analog conversion circuit (DAC) is required in order to equalize the reference voltages for gamma correction produced in each of the source driver ICs 20. Since dispersion of resistors and capacitors created on the chip is great, the current summing scheme such as an R-2R ladder network type DAC is considered to be inappropriate. Thus, the present embodiment uses a PDM type DAC relying on the time control scheme.

Figure 2:
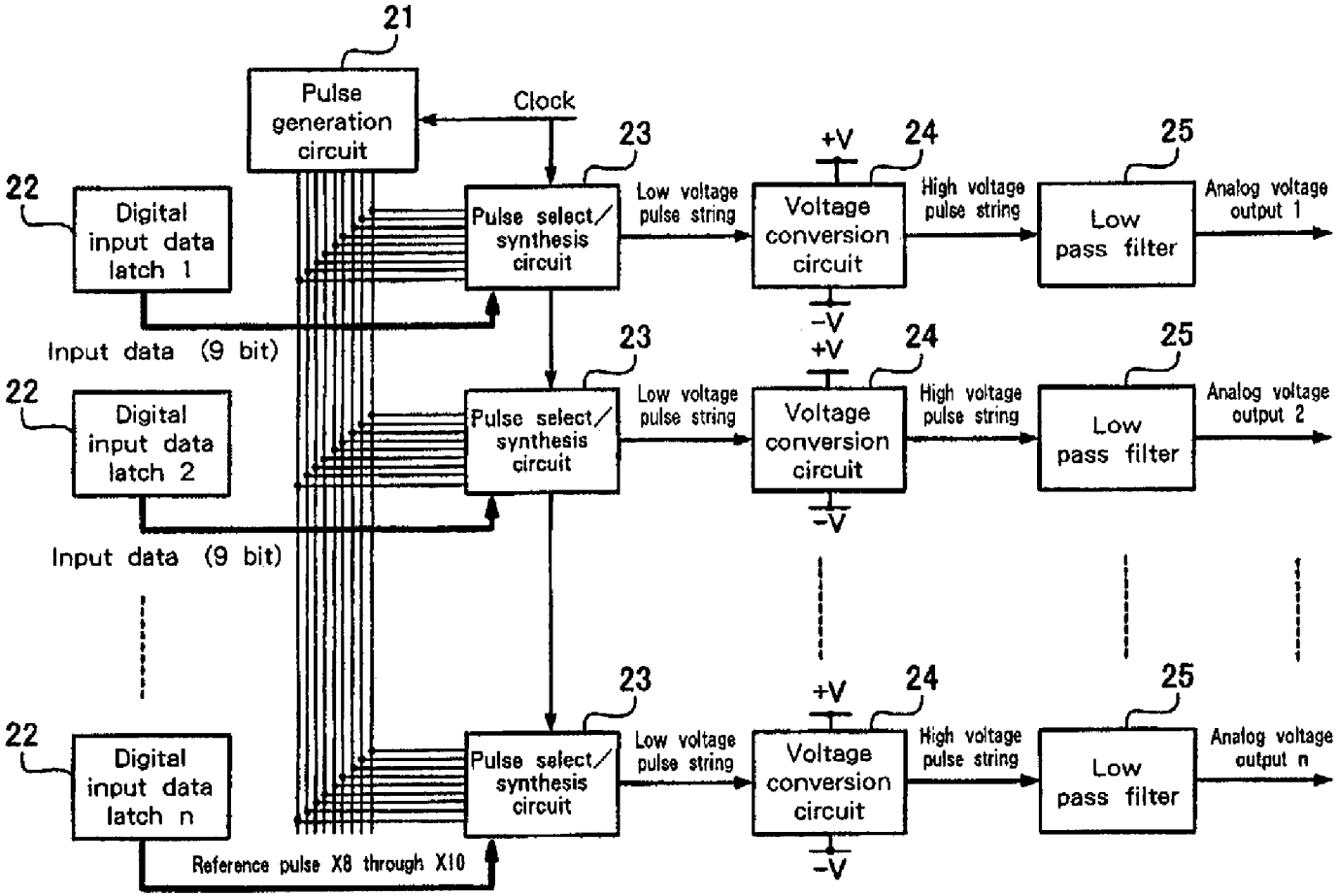
FIG. 2 depicts a schematic diagram of a PDM type of 9-bit DAC for generating gamma reference voltages according to the embodiment of the invention.

FIG. 2 depicts a schematic diagram of a PDM type of 9-bit DAC for generating gamma reference voltages according to the embodiment of the invention. According to the embodiment, a gamma reference voltage generation circuit as shown in FIG. 2 is provided for each of the source driver ICs 20 in source driver 7 of LCD. The circuit shown in FIG. 2 comprises a pulse generation circuit 21 for generating a plurality of reference pulses in which pulse generation densities are weighted, digital input data latches 22 for storing digital input data serving as gamma correction data, pulse select/synthesis circuits 23 for generating a pulse string by selecting and synthesizing necessary reference pulses on the basis of generated reference pulses and stored input data, voltage conversion circuits 24 for converting a pulse string generated by a digital power supply into a desired analog voltage range, and integration circuits (low pass filters) 25 for converting a pulse string into an analog voltage. Pulse generation circuit 21 is the most characteristic component in the embodiment, while digital input data latches 22 through integration circuits (low pass filters) 25 are provided as many as necessary gamma correction reference voltages, respectively.

Figure 16:
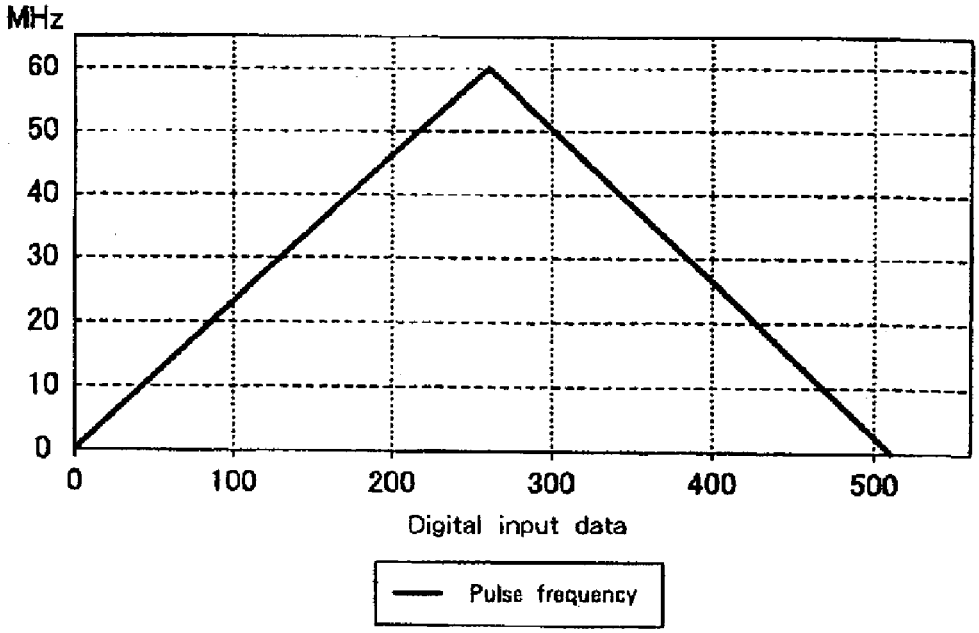
FIG. 16 is a diagram illustrating a relationship between each digital input data and its corresponding frequency of the pulse string for a PDM type DAC for liquid crystal displays.

In the embodiment, there is provided a DAC with a frequency characteristic having a trapezoidal shape, for example, in contrast to a triangular shape shown in FIG. 16 with a peak at 256, whereby the operating frequency is reduced compared with a conventional relationship between digital input data and a pulse string frequency shown in FIG.

16. Accordingly, a DAC of the present invention employs a pulse density modulation (PDM) scheme in a range of the digital input data other than a predetermined range around a medium value, while employing a pulse width modulation (PWM) scheme in the predetermined range around a medium value in order to avoid the increase of frequencies.

Figure 3:
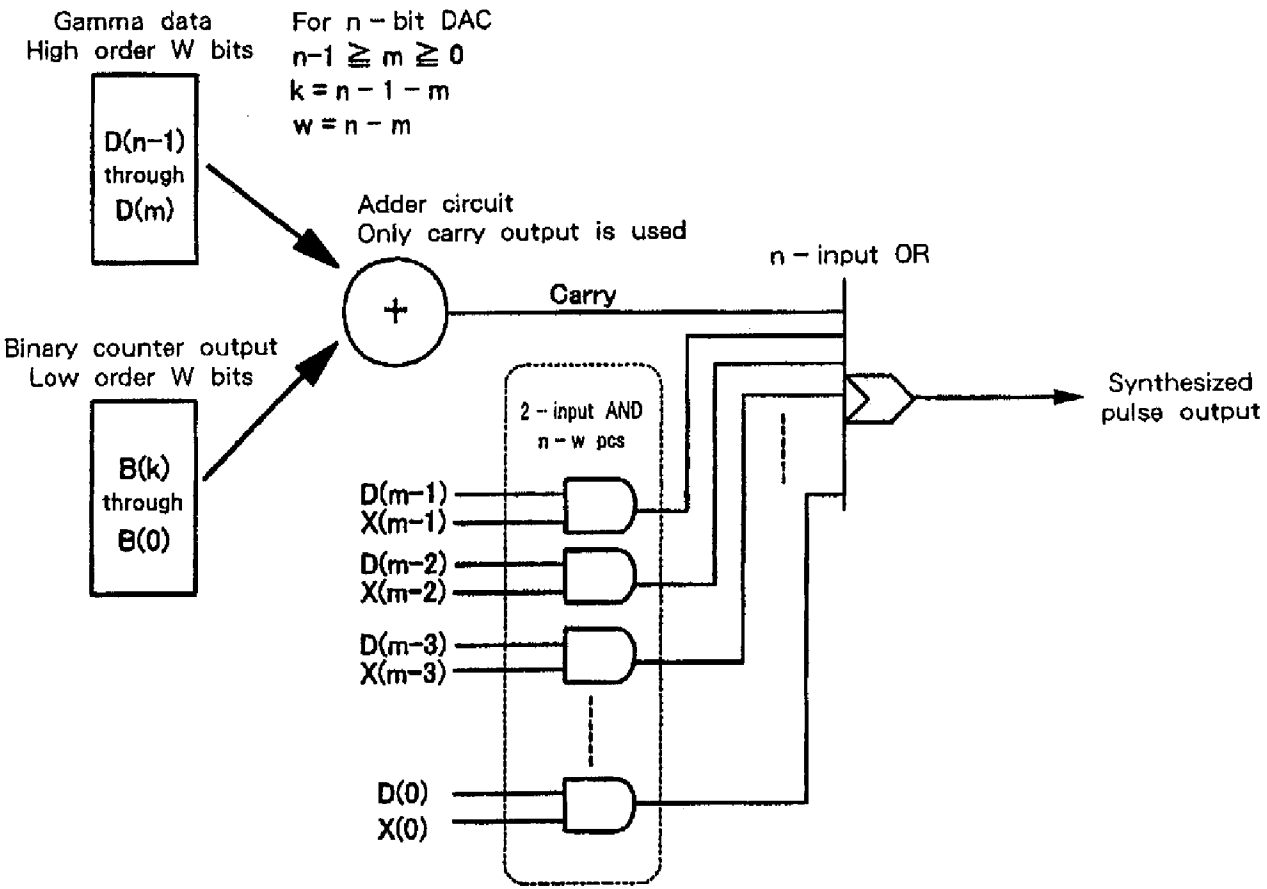
FIG. 3 depicts details of a pulse generation circuit and pulse select/synthesis circuit according to the embodiment of the invention.

FIG. 3 depicts details of pulse generation circuit 21 and pulse select/synthesis circuit 23. Here is shown how to generate pulses for an n-bit DAC assuming the digital input data is n bits rather than 9 bits. A synthesized pulse output obtained by the circuit shown in FIG. 3 is represented as a logical sum between a carry output from an adder circuit that receives as its inputs high order W bits of gamma data and low order W bits of binary counter outputs, and a logical product between outputs X(m−1) through X(0) of pulse generation circuit 21 and gamma data D(m−1) through D(0). Note that in the case of n-bit DAC, $n-1 \geqq m \geqq 0$, k=n−1−m, w=n−m.

FIG. 4 is a table illustrating a relationship between the number of divided bits and a maximum frequency of a pulse string when utilizing pulse generation circuit 21 and pulse select/synthesis circuits 23 of the present invention. It is seen that the maximum frequency of the generated pulse string varies depending on a value of the number of divided bits (W) so that the region also varies where the frequency of the pulse string is kept constant. It is also seen that as a value of W increases, the frequency of a pulse string decreases, however, the scale of the adder circuit will inconveniently increase.

As shown in FIG. 4, when W=1, the adder circuit is composed of only 2-input AND gates, thus resulting in a conventional PDM type DAC. When W=2, this is a special case where the circuit is simplified most because carry detection can be implemented by using only 2-input AND gates without using an adder circuit. In this case, the maximum frequency of the pulse string is f/2 (Hz) and a ratio of a region, where the number of switching times is constant, to the whole input data is ½. When W is more than or equal to 3, the frequency decreases compared with when W=2, the adder circuit is required to detect a carry, so that the scale of the circuit increases. In addition, the scale of integration circuit 25 following the synthesis circuit also increases. When W=n, the circuit becomes the same configuration as a PWM type DAC.

Figure 5:
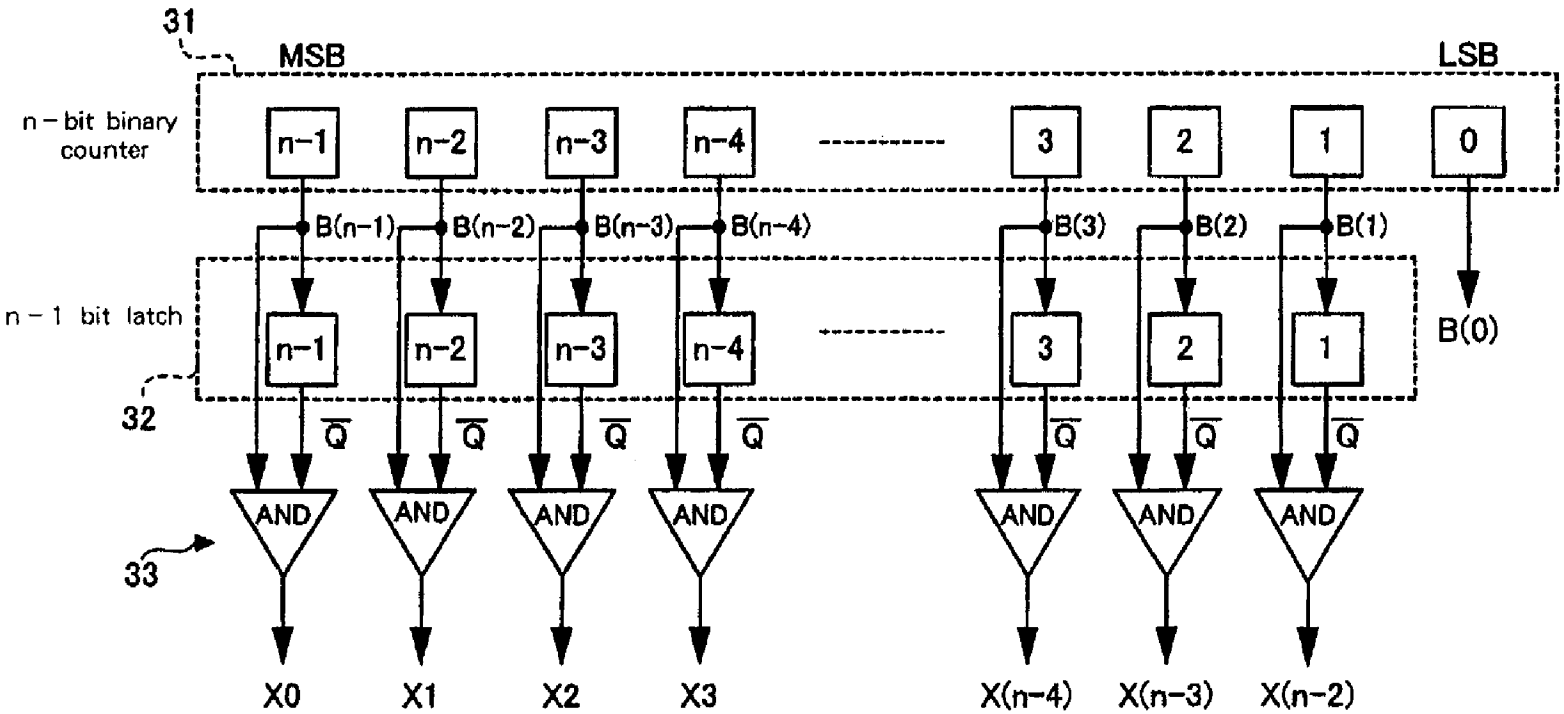
FIG. 5 depicts a schematic diagram of a pulse generation circuit in a PDM type DAC according to the present invention.

FIG. 5 depicts a schematic diagram of pulse generation circuit 21 in a PDM type DAC according to the present invention. This pulse generation circuit 21 comprises n-bit binary counter 31, n−1 bit latch 32, and n−1 2-input AND gates 33. As an output of pulse generation circuit 21, there is provided a logical product by 2-input AND gates 33 between outputs of n-bit binary counter 31 and outputs of n−1 bit latch 32. Namely, n−1 bit latch 32 generates a signal by delaying high order n−1 bits output B (n−1) through B(1) from n-bit binary counter 31 by one input clock period, and then 2-input AND gates 33 perform a logical operation with receiving as inputs the high order n−1 bits output B(n−1) through B(1) from n-bit binary counter 31 and delayed signals corresponding to the high order n−1 bits output B(n−1) through B(1) from n−1 bit latch 32.

It is preferable that the pulse generation circuit for liquid crystal display DACs generates pulses using a method in which the number of switching times does not vary in the midsection of the digital input data, in consideration of linearity after the pulse generation. Here is now described a method for improving linearity by taking a case by way of example where a pulse string is considered in units of 4 clock when the number of divided bits W=2. Based on a 4 clock unit, there exist four methods for embedding pulses corresponding to higher bits in order to increase the pulse density in the block along with the increase of the digital input data. Below is shown how the number of bits increases according to these four methods:

Method 1: 0000→P000→0001→P001→0110→P110→0111→P111→1111

Method 2: 0000→P000→0001→P001→0011→P011→0111→P111→1111

Method 3: 0000→P000→0100→P100→0110→P110→0111→P111→1111

Method 4: 0000→P000→0100→P100→0011→P011→0111→P111→1111

It is noted that P is a pulse depending on modulation data. Now a reference pulse generation circuit of the present invention will be described below that uses the above methods 1 and 3 to reduce the scale of the circuits.

Figure 6:
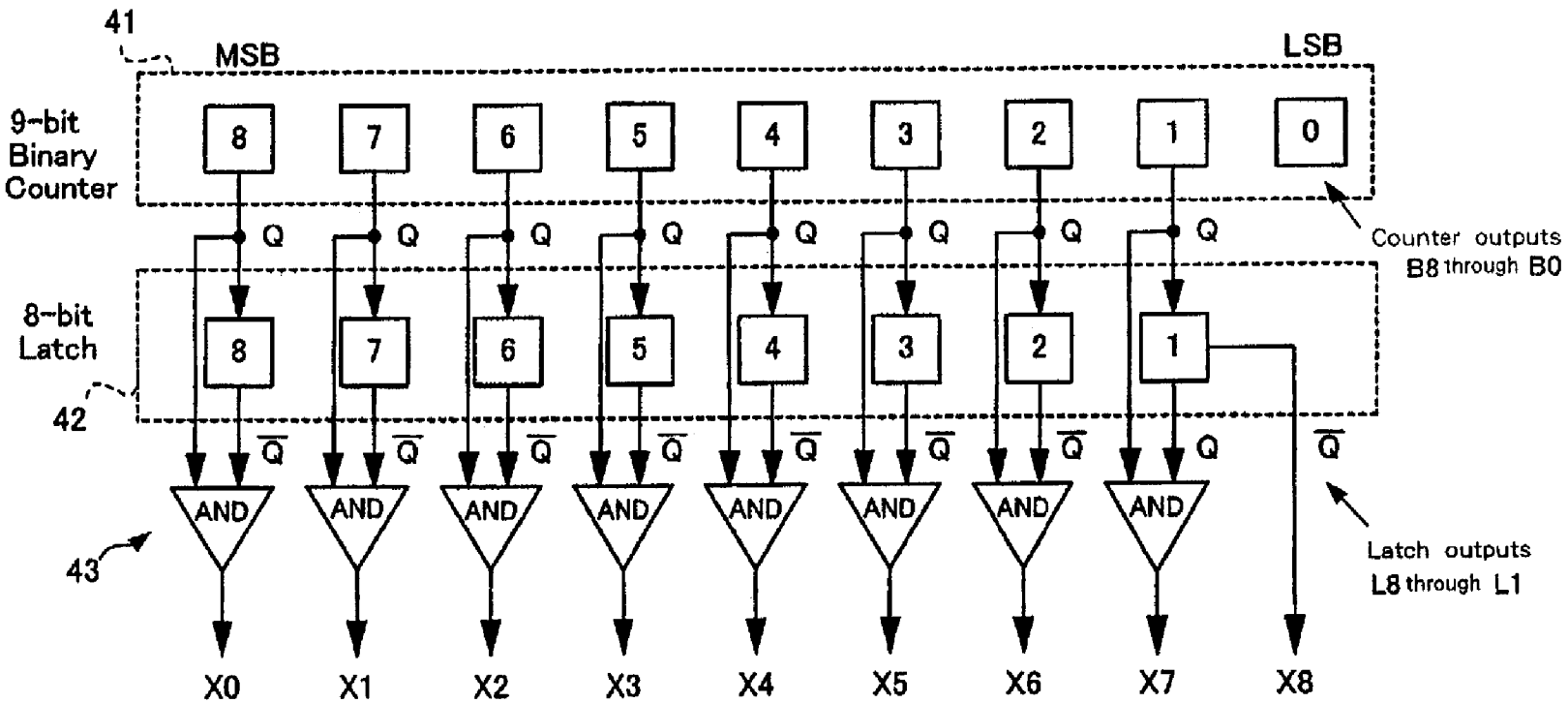
FIG. 6 depicts a schematic diagram of a pulse generation circuit using method 1.

FIG. 6 depicts a schematic diagram of pulse generation circuit 21 using the above method 1. There is shown a 9-bit DAC that comprises 9-bit binary counter 41, 8-bit latch 42, and eight 2-input AND gates 43. 9-bit binary counter 41 counts up in synchronization with an input clock and supplies counter outputs B8 through B1. Corresponding to those counter outputs B8 through B1, there are generated latch outputs L8 through L1 that are the signals delayed by one input clock period with 8-bit latch 42. These signals are processed according to the logical expression shown in the above method 1 to generate reference pulse outputs X8 through X0. Considering a general case shown in FIG. 5, when n=9, 2-input AND gates 43 perform a logical operation with receiving as inputs the high order n−1 bits output B(8) through B(1) and delayed signals corresponding to those high order n−1 bits output from 8-bit latch 42 and then output X(0) through X(n−2). Note that output X(n−1), that is, X8 is output without passing through the logical circuit, as shown in FIG. 6.

The logical expression for the pulse generation circuit shown in FIG. 6 (i.e., Method 1) are summarized as follows:

| | |
|---|---|
| X8<=not L1; | Logical expression (1) |
| X7<=B1 and L1; | Logical expression (2) |
| X6<=B2 and (not L2); | Logical expression (3) |
| X5<=B3 and (not L3); | Logical expression (4) |
| X4<=B4 and (not L4); | Logical expression (5) |
| X3<=B5 and (not L5); | Logical expression (6) |
| X2<=B6 and (not L6); | Logical expression (7) |
| X1<=B7 and (not L7); | Logical expression (8) |
| X0<=B8 and (not L8); | Logical expression (9) |

The above logical expression (1) reduces the frequency of the reference pulse output X8 to half, while the above logical expression (2) shifts the pulse generation position of the reference pulse output X7 by 1 clock. Assuming that the density of reference pulse X0 is 1, the densities of reference pulses X1, X2, X3, X4, X5, X6, X7 and X8 generated by this scheme are 2, 4, 8, 16, 32, 64, 128 and 256, respectively. Since the reference pulses X0 through X8 are generated such that they become high exclusively, these pulses never overlap temporally each other even if any plural number of reference pulses are synthesized.

Figure 7:
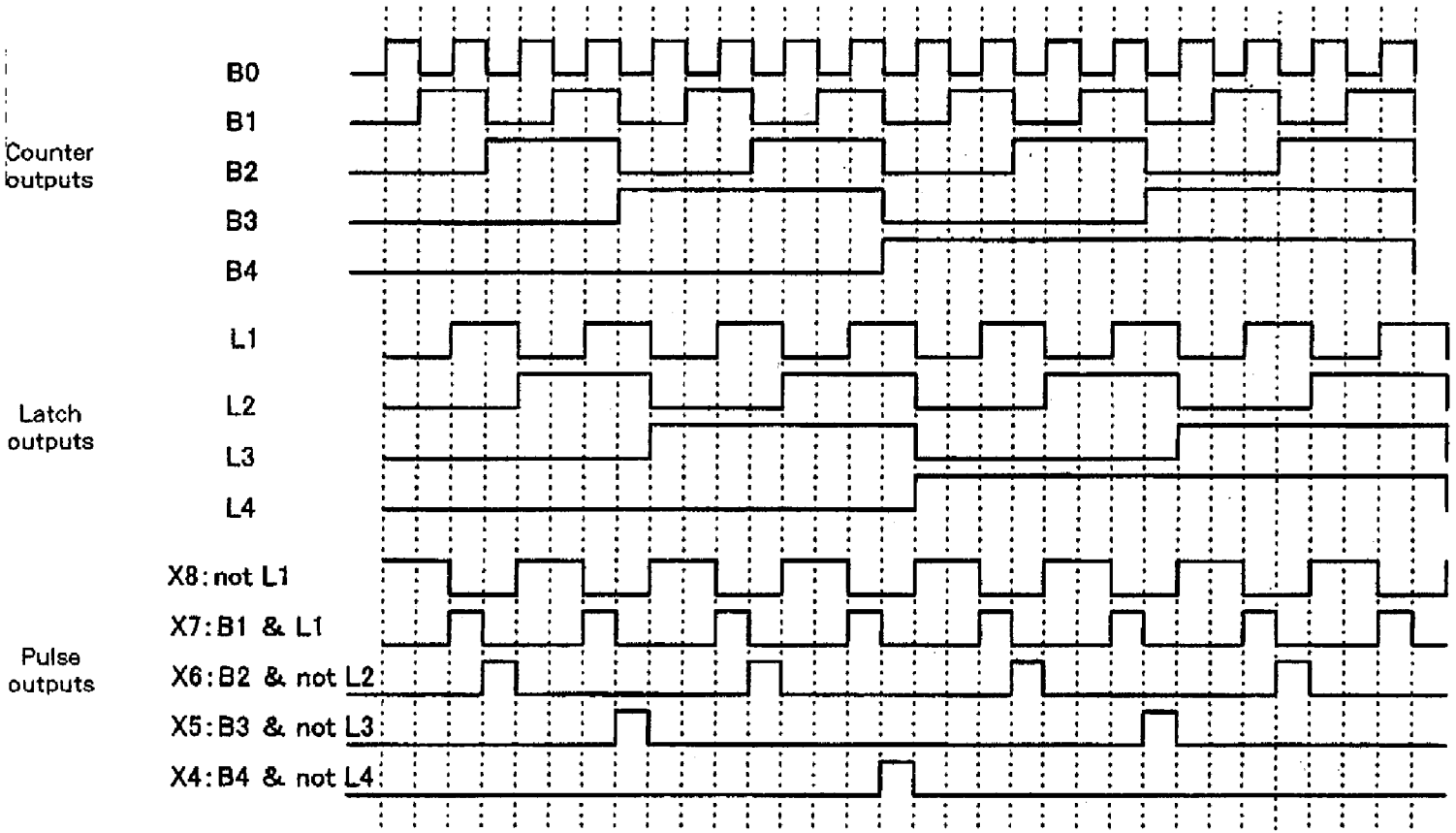
FIG. 7 depicts reference pulse waveforms according to method 1 shown in FIG. 6.

FIG. 7 depicts reference pulse waveforms according to method 1 shown in FIG. 6. As is seen from the drawing, the pulses X6 through X0 are generated such that they become high in the timing next to when X8 and X7 are in a high state. Accordingly, as the digital input data increases within a range of 0 to 128, the frequency of the pulse string increases monotonously, whereas X8 or X7 is selected for the digital input data within a range of 128 to 384, wherein any of X6 through X0 in the high state selected at the same time is combined to the high state of X8 or X7. Therefore, the frequency of the synthesized pulse string is kept constant for the digital input data ranging from 128 to 384. For the digital input data ranging from 384 to 511, as the input data increases, the frequency of the pulse string decreases monotonously. The above also applies to an n-bit DAC other than 9-bit DAC.

Figure 8:
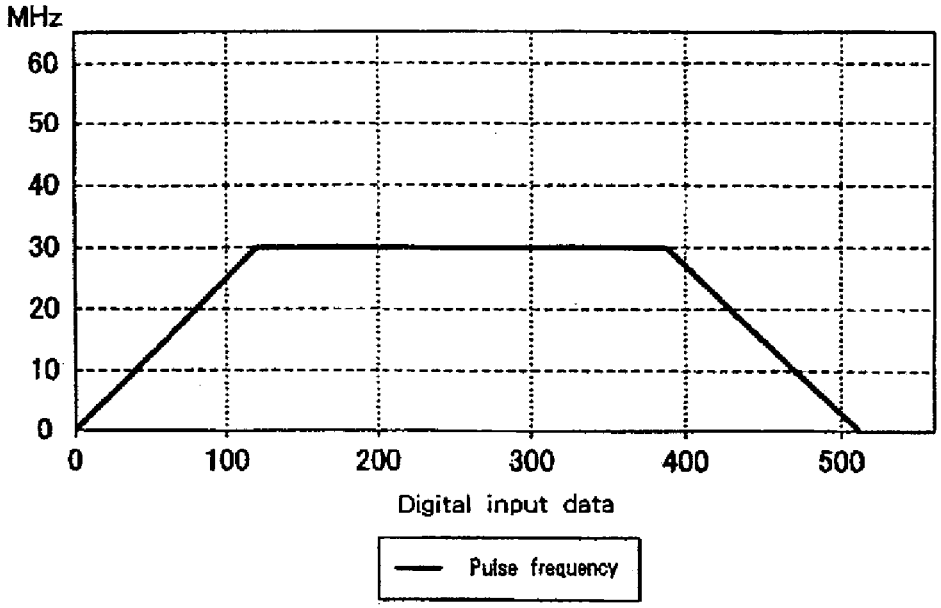
FIG. 8 is a diagram illustrating a relationship between digital input data and pulse string frequencies for a pulse generation circuit according to the present invention.

FIG. 8 is a diagram illustrating a relationship between digital input data and its corresponding frequency of the pulse string for pulse generation circuit 21 according to the invention, wherein the input clock is 120 MHz. As is seen by comparing with the prior art shown in FIG. 16, the frequency of the pulse string is kept constant for the digital input data within a range of 128 to 384. In this way, using pulse generation circuit 21 of the present invention, the maximum frequency of the pulse string is able to be reduced to half. When generating an analog output voltage in this range, the number of switching times for voltage conversion circuits 24 to drive integration circuit 25 is able to be kept constant. Accordingly, the adverse effect on the analog output voltage due to switching is maintained uniformly, thus the linearity is expected to be improved. When driving the liquid crystal display at 5 V, this range, that is, 128 to 384 of digital input data corresponds to 1.25V to 3.75V of analog output voltage whose dynamic range is between 0V and 5V. This range corresponds to a portion where the liquid crystal display changes most steeply, and which is most sensitive, that is, the most important voltage range to drive the liquid crystal display. Therefore, it is clear that a great effect is brought about by the present invention.

Figure 9:
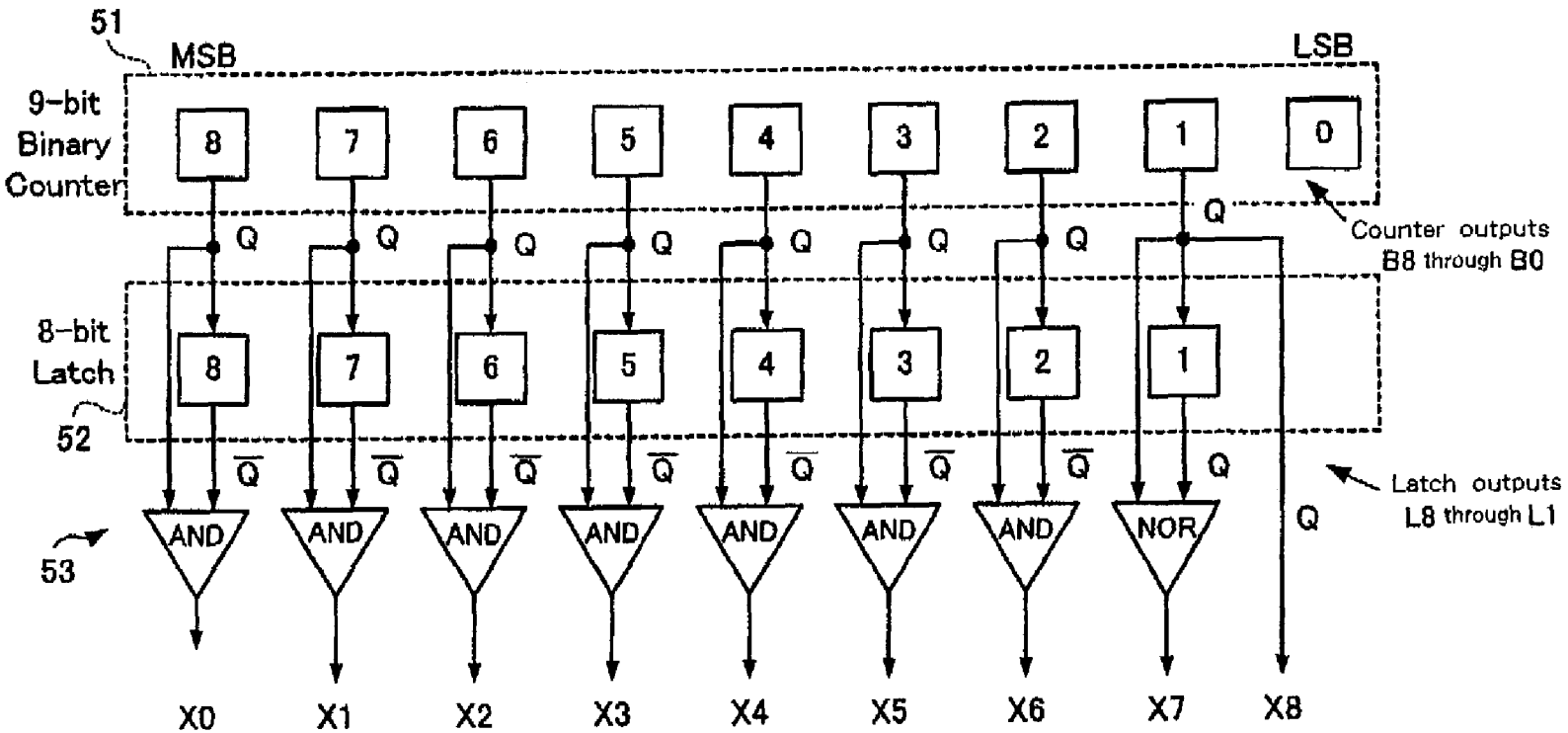
FIG. 9 depicts a schematic diagram of a pulse generation circuit using method 3.

FIG. 9 depicts a schematic diagram of pulse generation circuit 21 with W=2 using the above method 3 apart from that shown in FIG. 6. As with the case in FIG. 6, there is shown a 9-bit DAC that comprises 9-bit binary counter 51, 8-bit latch 52, and eight 2-input AND gates 53. Unlike the method 1 shown in FIG. 6, one NOR circuit is provided instead of an AND circuit. As with FIG. 6, 9-bit binary counter 51 counts up in synchronization with an input clock and supplies counter outputs B8 through B1. Corresponding to those counter outputs B8 through B1, there are generated latch outputs L8 through L1 that are the signals delayed by one input clock period with 8-bit latch 52. These signals are processed according to the logical expression shown in the above method 3 to generate reference pulse outputs X8 through X0.

The logical expression for the pulse generation circuit shown in FIG. 9 (i.e., Method 3) are summarized as follows:

| | |
|---|---|
| X8<=B1; | Logical expression (1') |
| X7<=B1 nor L1; | Logical expression (2') |
| X6<=B2 and (not L2); | Logical expression (3) |
| X5<=B3 and (not L3); | Logical expression (4) |
| X4<=B4 and (not L4); | Logical expression (5) |
| X3<=B5 and (not L5); | Logical expression (6) |
| X2<=B6 and (not L6); | Logical expression (7) |
| X1<=B7 and (not L7); | Logical expression (8) |
| X0<=B8 and (not L8); | Logical expression (9) |

The above expressions (1') and (2') are different from those of method 1 shown in FIG. 6, while the others are the same as in method 1. The above logical expression (1') reduces the frequency of the reference pulse output X8 to half, while the logical expression (2) shifts the pulse generation position of the reference pulse output X7 by 1 clock. Assuming that the density of reference pulse X0 is 1, the densities of reference pulses X1, X2, X3, X4, X5, X6, X7 and X8 are 2, 4, 8, 16, 32, 64, 128 and 256, respectively. Since the reference pulses X0 through X8 are generated such that they become high exclusively, these pulses never overlap temporally each other even if any plural number of reference pulses are synthesized.

Figure 10:
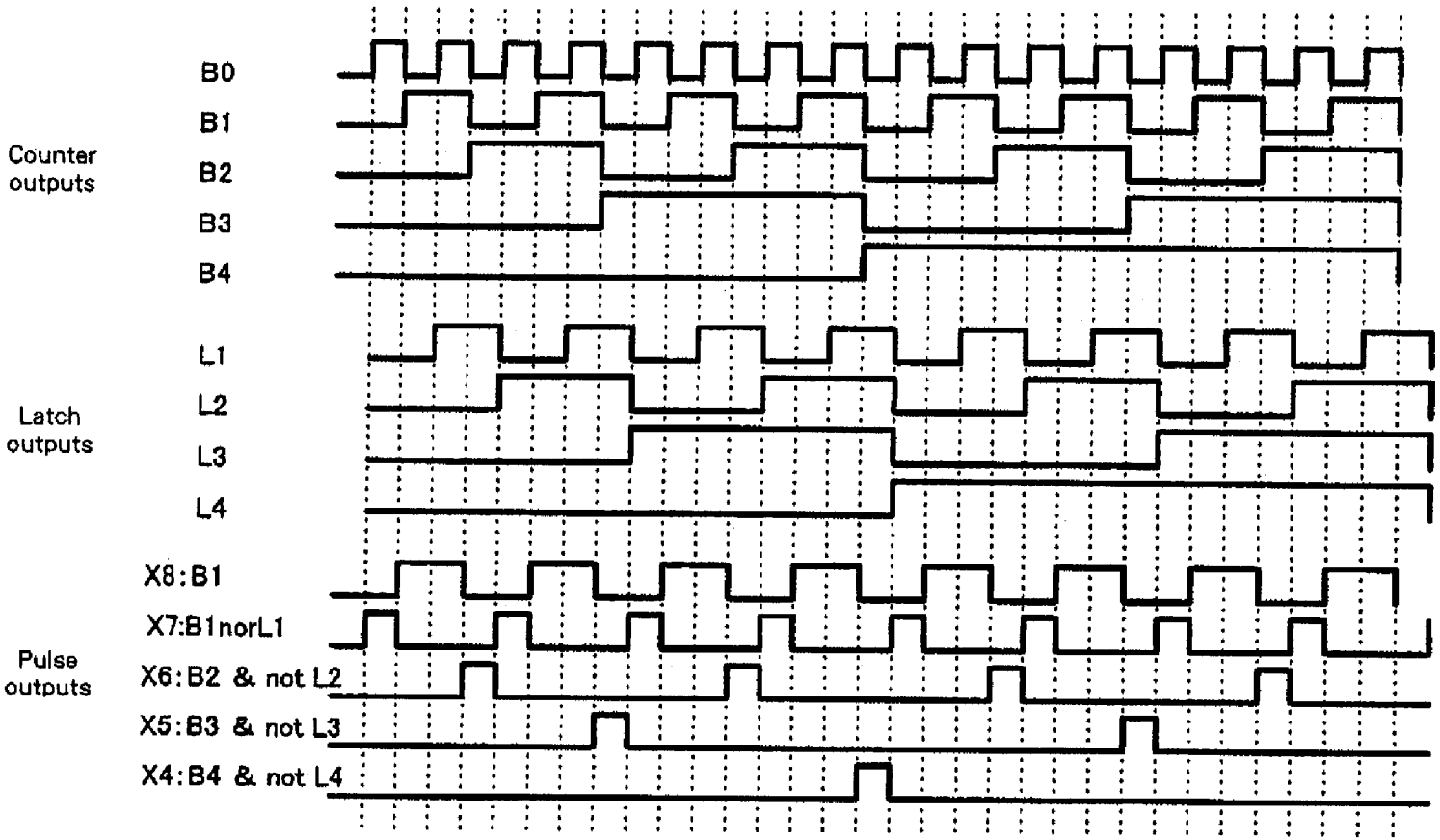
FIG. 10 depicts reference pulse waveforms according to method 3 shown in FIG. 9.

FIG. 10 depicts reference pulse waveforms according to method 3 shown in FIG. 9. As with FIG. 7, the pulses X6 through X0 are generated such that they become high in the timing next to when X8 and X7 are in a high state. Accordingly, as the digital input data increases within a range of 0 to 128, the frequency of the pulse string increases monotonously, whereas X8 or X7 is selected for the digital input data within a range of 128 to 384, wherein any of X6 through X0 in the high state selected at the same time is combined to the high state of X8 or X7. Therefore, the frequency of the synthesized pulse string is kept constant for the digital input data ranging from 128 to 384. For the digital input data ranging from 384 to 511, as the input data increases, the frequency of the pulse string decreases monotonously. It is noted that the relationship between digital input data and a pulse string frequency when using the above method 3 shown in FIGS. 9 and 10 is the same as that shown in FIG. 8, thereby achieving the same effects.

Next, let's consider the case where the number of divided bits W=3, that is, a pulse string is considered on an 8 clock basis. Here is now described a method where the pulse density in blocks increases along with the increase of digital input data. Based on an 8 clock unit, there exist two methods for increasing the pulse density in the block along with the increase of the digital input data. Below is shown how the number of bits increases according to these two methods:

Method 1: 00000000→P0000000→00000001→P0000001→00000011→P0000011→00000111→P00000111→00001111→P0001111→00011111→P0011111→0011111→P0111111→01111111→P1111111→11111111

Method 2: 00000000→P0000000→01000000→P1000000→01100000→P1100000→01110000→P1110000→01111000→P1111000→01111100→P1111100→01111110→P1111110→01111111→P1111111→11111111

It is noted that P is a pulse depending on modulation data.

Since the scale of the reference pulse generation circuit using the above method 2 becomes large, here is now be described about the reference pulse generation circuit using the above method 1.

Figure 11:
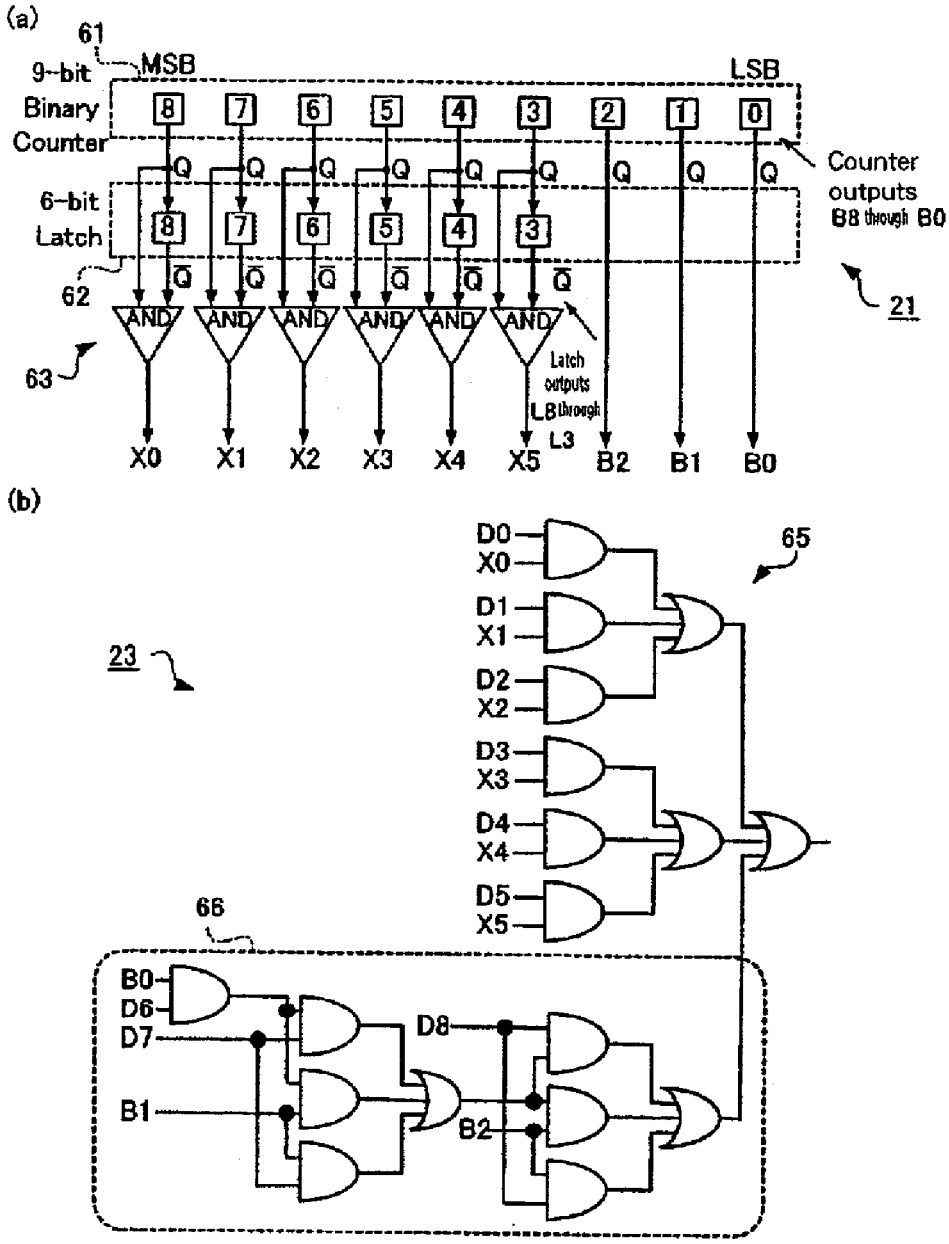
FIGS. 11(*a*) and (*b*) depict a pulse generation circuit and pulse select/synthesis circuit, respectively, for a PDM type DAC based on 8 clock unit.
Figure 13:
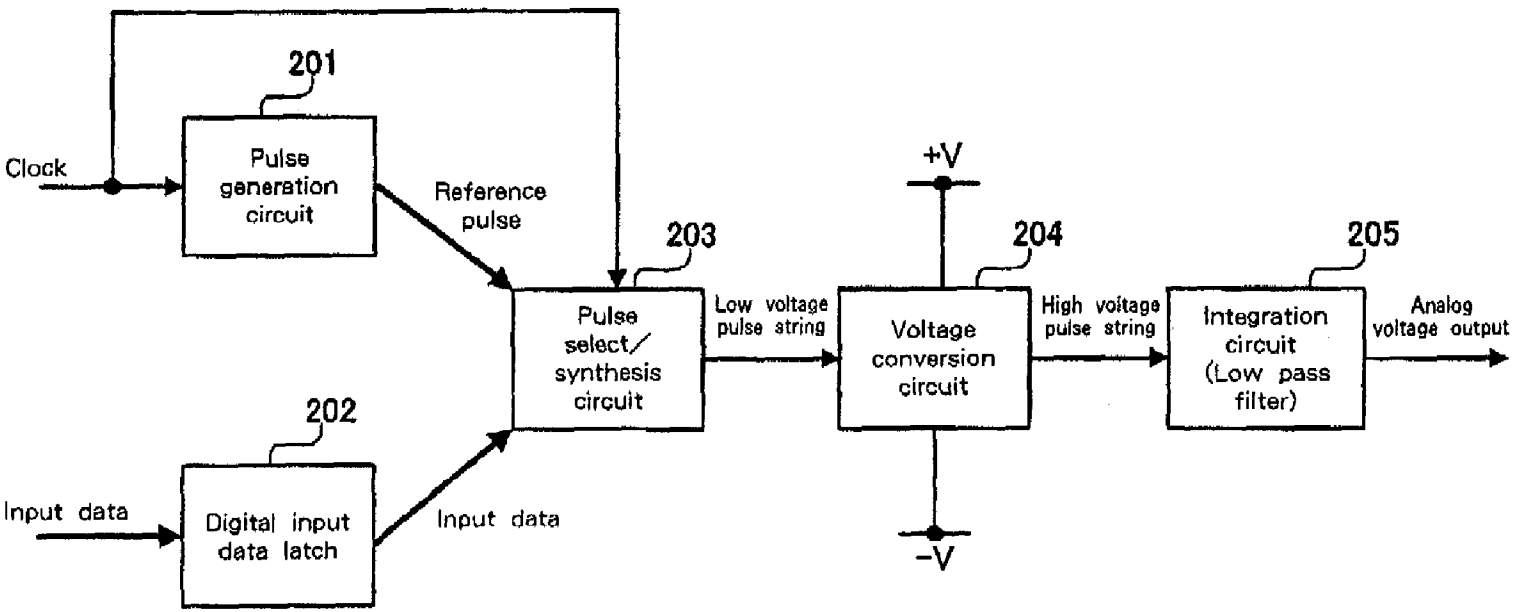
FIG. 13 depicts a configuration of a typical PDM type DAC.
Figure 14:
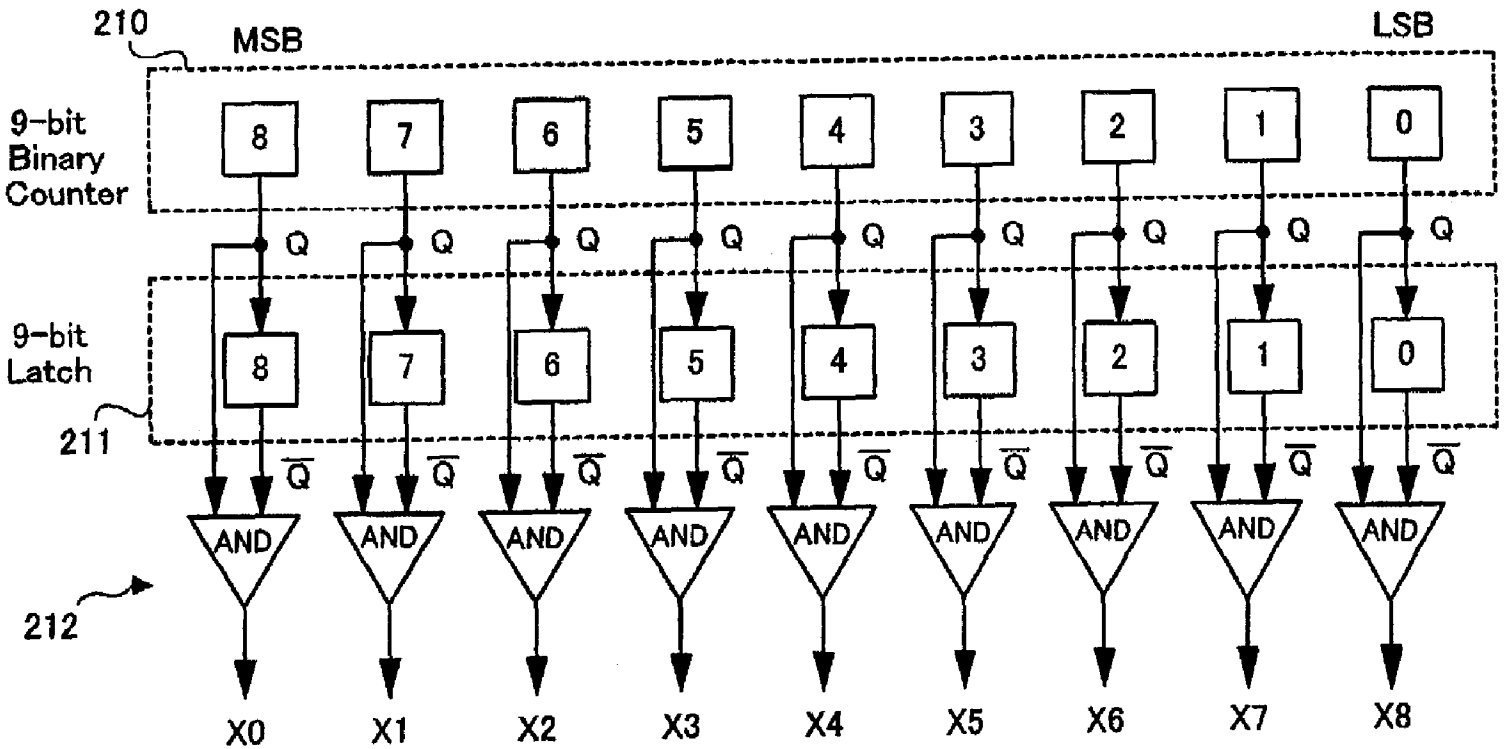
FIG. 14 depicts a schematic diagram of a pulse generation circuit for use in a PDM type DAC for liquid crystal displays.
Figure 15:
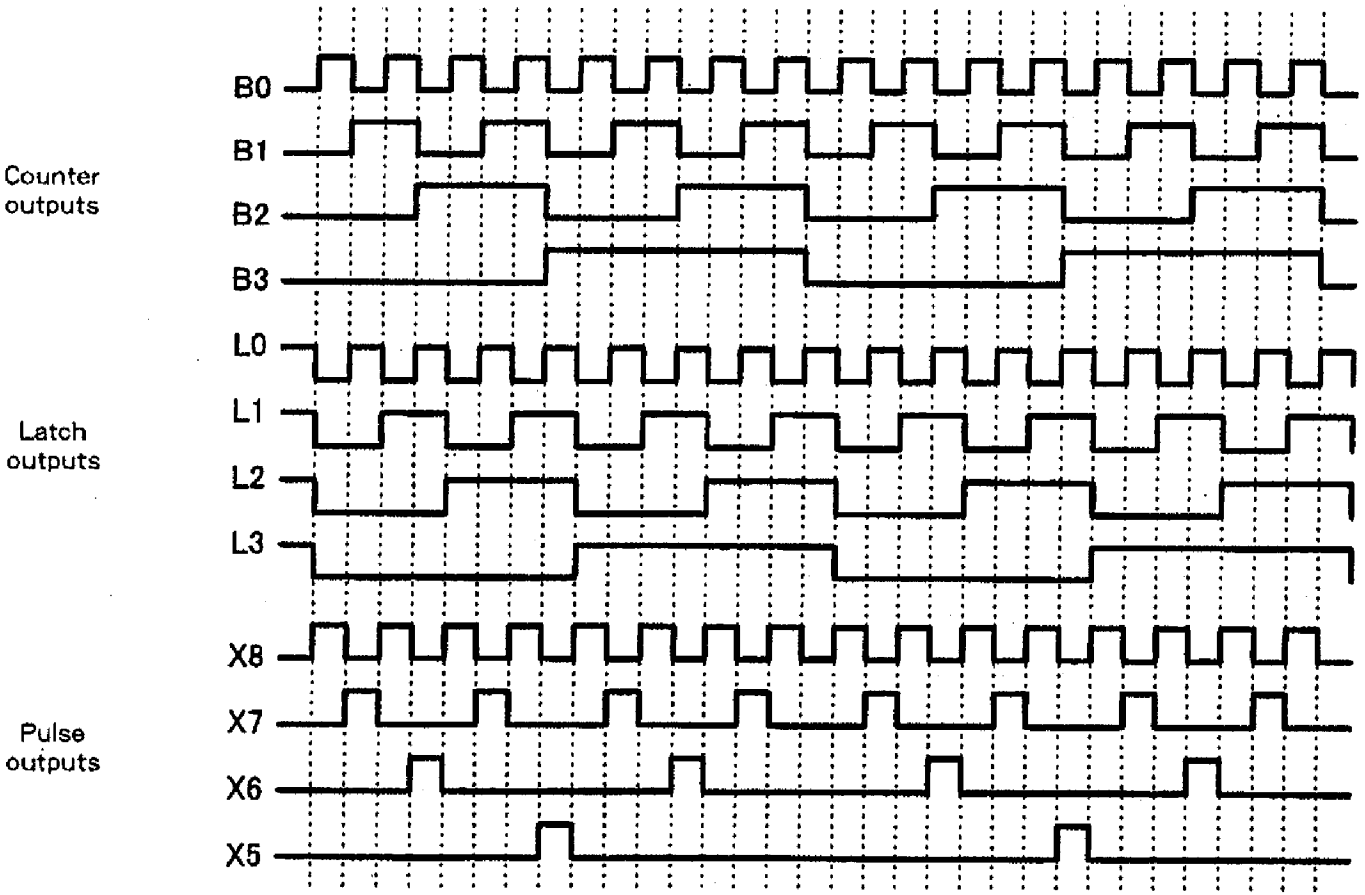
FIG. 15 depicts a waveform of pulse outputs (X8 through X5) of a PDM type DAC.

FIGS. 11(*a*) and (*b*) depict pulse generation circuit 21 and pulse select/synthesis circuit 23 for a PDM type DAC based on 8 clock unit, wherein FIG. 11(*a*) shows pulse generation circuit 21 and FIG. 11(*b*) shows pulse select/synthesis circuits 23. Pulse generation circuit 21 shown in FIG. 11(*a*) comprises 9-bit binary counter 61, 6-bit latch 62, and six 2-input AND gates 63. On the other hand, pulse select/synthesis circuits 23 shown in FIG. 11(*b*) comprises a synthesis circuit 65 including 2-input AND gates and 3-input OR gates, and an adder circuit 66 serving as a carry detection section.

In order to generate pulse modulation with 8 clocks, outputs B0, B1 and B2 of binary counter 61 are directly input to adder circuit 66 shown in FIG. 11(*b*) without being latched. The frequency of the synthesized pulse string is kept constant for the digital input data within the range of 64 to 448. Compared with the case of 4 clock unit, the pulse string frequency is further reduced to half while the number of gates increases.

FIG. 12 is a table comparing the size of pulse generation circuit 21 between 4 clock unit and 8 clock unit. The former is based on pulse generation circuit 21 shown in FIG. 6, while the latter is based on pulse generation circuit 21 shown in FIG. 11(*a*). As seen from FIG. 12, considering the pulse synthesis section for 10 sets, the number of gates required for the 8 clock unit is 1.4 times that of the 4 clock unit. Therefore, the 4 clock unit is superior in terms of the circuit scale, while the 8 clock unit is superior in terms of the frequency.

As described above, according to the embodiment of the invention, the frequency is reduced for a predetermined range of digital input data around its medium value to keep the number of switching times constant, thereby reducing the power consumption of a PDM type DAC for the liquid crystal display and improving linearity of output voltage. As a result, linearity of analog output voltage is improved, which allows to reduce deviation of reference voltages for gamma correction between each of the source driver ICs 20. Furthermore, compared with typical PDM type DACs, wasted power consumption is reduced, thereby reducing power consumption of LCD panels advantageously.

When the number of divided bits W=2 as shown in FIG. 6 through FIG. 10, an effect is brought out for digital input data within a range of 128 to 384 at 9-bit DAC. As described above, this corresponds to 1.25V to 3.75V of analog output voltage when driving the liquid crystal display at 5 V and which is the most important voltage range, thus the great effect is expected according to the present invention. When it is necessary to improve linearity in an even wider range and to reduce the operating frequency, pulse generation circuit 21 and pulse select/synthesis circuits 23 shown in FIG. 11(*a*) and (B) may be used. Namely, considering the trade-off between the improvement of linearity and the circuit scale based on the characteristics shown in FIG. 4 to determine an appropriate number of divided bits for pulse generation circuit 21, an optimal configuration for a target LCD can be obtained.

The present invention has been described with respect to DACs implementing a reference voltage generation circuit for gamma correction in a liquid crystal display, however, the invention is also applicable to reference pulse generation circuits in other fields, including a DAC used for measuring instruments. However, by applying the present invention to an LCD implementing WOA, a great improvement will be achieved in terms of both linearity and the circuit scale reduction.

As mentioned above, according to the present invention, it becomes possible to suppress adverse effects upon an analog output voltage due to switching depending on digital input data.

The invention claimed is:

1. A liquid crystal display driver for applying a voltage to liquid crystal cells forming an image display area, comprising:

a pulse generation circuit for generating a plurality of reference pulses in which pulse generation densities are weighted;

a pulse select/synthesis circuit for generating a pulse string by selecting and synthesizing necessary reference pulses on the basis of digital input data and said reference pulses, wherein said pulse generation circuit generates said reference pulses without changing a number of switching times per time unit for a predetermined range of said digital input data around a medium value, wherein said pulse strings comprise a frequency characteristic having a trapezoidal shape corresponding to said digital input data;

an integration circuit for integrating the pulse string generated by said pulse select/synthesis circuit to output a voltage for gamma correction, wherein said pulse select/synthesis circuit outputs a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0), and wherein if said digital input data is n bits, then said pulse generation circuit outputs the reference pulses using an n-bit binary counter, an n−1 bit latch, and n−1 2-input gates.

2. A reference pulse generation circuit for generating reference pulses corresponding to n-bit digital input data, consisting of:

an n-bit binary counter for counting up in synchronization with an input clock;

an n−1 bit latch for generating signals by delaying high order n−1 bits output B(n−1) through B(1) from said binary counter by one input clock period; and n−1 logical circuits for performing logical operations with receiving as inputs said high order n−1 bits output B(n−1) through B(1) from said binary counter and the delayed signals corresponding to the high order n−1 bits output B(n−1) through B(1) from said n−1 bit latch and obtaining outputs X(0) through X(n−2) with lower reference pulse densities, whereas output X(n−1) is obtained bypassing the logical circuit, wherein said reference pulses comprise a frequency characteristic having a trapezoidal shape corresponding to said n-bit digital input data, wherein said n−1 logical circuits are n−1 AND circuits, and wherein said n−1 logical circuits are n−2 AND circuits outputting X(0) through X(n−3) and a NOR circuit outputting X(n−2).

3. A liquid crystal display, comprising:

liquid crystal cells forming an image display area on a substrate; and a driver for applying a voltage to said liquid crystal cells based on a reference voltage for gamma correction corresponding to digital input data, wherein said driver keeps a number of switching times for pulse strings per time unit constant for a predetermined range of said digital input data when generating the pulse strings with pulse densities corresponding to said digital input data, wherein said pulse strings comprise a frequency characteristic having a trapezoidal shape corresponding to said digital input data, wherein said driver comprises a pulse generation circuit for generating a plurality of reference pulses in which pulse generation densities are weighted; and a pulse select/synthesis circuit for generating a pulse string by selecting and synthesizing necessary reference pulses on the basis of digital input data and said reference pulses, and wherein said pulse select/synthesis circuit outputs a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

4. The liquid crystal display according to claim 3, wherein said driver is mounted on said substrate and is comprised of a plurality of driver ICs connected via signal lines.

5. The liquid crystal display according to claim 3, wherein said predetermined range of said digital input data is a predetermined range around a medium value of said digital input data.

6. A liquid crystal display, comprising:

liquid crystal cells forming an image display area on a substrate; and a driver for applying a voltage to said liquid crystal cells based on a reference voltage for gamma correction corresponding to digital input data, wherein said driver has no local peak in a number of switching times for pulse strings per time unit when generating the pulse strings with pulse densities corresponding to said digital input data, wherein said pulse strings comprise a frequency characteristic having a trapezoidal shape corresponding to said digital input data, wherein said driver comprises a pulse generation circuit for generating a plurality of reference pulses in which pulse generation densities are weighted; and a pulse select/synthesis circuit for generating a pulse string by selecting and synthesizing necessary reference pulses on the basis of digital input data and said reference pulses, and wherein said pulse select/synthesis circuit outputs a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

7. A liquid crystal display, comprising:

liquid crystal cells forming an image display area on a substrate; and a driver for applying a voltage to said liquid crystal cells based on a reference voltage for gamma correction corresponding to digital input data, wherein said driver obtains an output voltage using pulse density modulation (PDM) as well as obtains an output voltage using pulse width modulation (PWM) for a predetermined range of said digital input data around a medium value when generating pulse strings corresponding to said digital input data, wherein said pulse strings comprise a frequency characteristic having a trapezoidal shape corresponding to said digital input data, wherein said driver comprises a pulse generation circuit for generating a plurality of reference pulses in which pulse generation densities are weighted; and a pulse select/synthesis circuit for generating a pulse string by selecting and synthesizing necessary reference pulses on the basis of digital input data and said reference pulses, and wherein said pulse select/synthesis circuit outputs a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

8. A liquid crystal display driver for applying a voltage to liquid crystal cells forming an image display area, comprising:

a pulse generation circuit for generating a plurality of reference pulses in which pulse generation densities are weighted;

a pulse select/synthesis circuit for generating a pulse string by selecting and synthesizing necessary reference pulses on the basis of digital input data and said reference pulses, wherein said pulse generation circuit generates said reference pulses without changing a number of switching times per time unit for a predetermined range of said digital input data around a medium value, wherein said pulse strings comprise a frequency characteristic having a trapezoidal shape corresponding to said digital input data; and an integration circuit for integrating the pulse string generated by said pulse select/synthesis circuit to output a voltage for gamma correction, wherein said pulse select/synthesis circuit outputs a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

9. The liquid crystal display driver according to claim 8, assuming that said digital input data is n bits, wherein said pulse generation circuit outputs the reference pulses using an n-bit binary counter, an n−1 bit latch, and n−1 2-input gates.

10. A reference pulse generation circuit for generating reference pulses corresponding to n-bit digital input data, comprising:

an n-bit binary counter for counting up in synchronization with an input clock;

an n−1 bit latch for generating signals by delaying high order n−1 bits output B(n−1) through B(1) from said binary counter by one input clock period; and n−1 logical circuits for performing logical operations with receiving as inputs said high order n−1 bits output B(n−1) through B(1) from said binary counter and the delayed signals corresponding to the high order n−1 bits output B(n−1) through B(1) from said n−1 bit latch and obtaining outputs X(0) through X(n−2) with lower reference pulse densities, whereas output X(n−1) is obtained bypassing the logical circuit, wherein said reference pulses comprise a frequency characteristic having a trapezoidal shape corresponding to said n-bit digital input data.

11. The reference pulse generation circuit according to claim 10, wherein said n−1 logical circuits are n−1 AND circuits.

12. The reference pulse generation circuit according to claim 10, wherein said n−1 logical circuits are n−2 AND circuits outputting X(0) through X(n−3) and a NOR circuit outputting X(n−2).

13. A reference pulse generation circuit for digital-analog conversion employing a pulse density modulation scheme, comprising:

means for generating reference pulses that are exclusively in a high state corresponding to digital input data; and means for generating the reference pulses such that a number of switching times for pulse strings per time unit is constant for a predetermined range of said digital input data around a medium value, wherein said pulse strings comprise a frequency characteristic having a trapezoidal shape corresponding to said digital input data, wherein said reference pulses comprise pulse generation densities that are weighted, and wherein said pulse strings are generated by selecting and synthesizing necessary reference pulses on the basis of digital input data and said reference pulses;

means for integrating the pulse strings to output a voltage for gamma correction; and means for outputting a logical sum between a carry output from an adder circuit which has as its inputs high order W bits of the digital input data of n bits and low order W bits of a binary counter, and a logical product between outputs X(m−1) through X(0) of said pulse generation circuit where m=n−W and the digital input data D(m−1) through D(0).

14. The reference pulse generation circuit according to claim 13, wherein the reference pulses are generated with the frequency thereof being kept constant for half the whole range of said digital input data.

15. A method for generating reference pulses in a digital-analog converter, said method comprising:

generating pulse strings with pulse densities corresponding to digital input data that is input to said digital-analog converter; and keeping a number of switching times for said pulse strings per time unit constant for a predetermined range of said digital input data around a medium value, wherein said pulse strings comprise a frequency characteristic having a trapezoidal shape corresponding to said digital input data, wherein said reference pulses comprise pulse generation densities that are weighted, and wherein said pulse strings are generated by selecting and synthesizing necessary reference pulses on the basis of digital input data and said reference pulses;

integrating the pulse strings to output a voltage for gamma correction; and outputting a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

16. The method according to claim 15, further comprises the step of reducing a maximum frequency of said pulse strings to less than half of that in the case where the number of switching times is not kept constant.

17. A method for providing an analog voltage output corresponding to digital input data, said method comprising:

generating reference pulses that are exclusively in a high state corresponding to digital input data;

for a range of said digital input data excluding a predetermined range around a medium value, integrating a pulse string, whose number of pulses is adjusted depending on said digital input data, to output an analog voltage; and for the predetermined range of said digital input data around said medium value, integrating a pulse string, whose duty is adjusted depending on said digital input data, to output an analog voltage, wherein said pulse strings comprise a frequency characteristic having a trapezoidal shape corresponding to said digital input data wherein said reference pulses comprise pulse generation densities that are weighted, and wherein said pulse strings are generated by selecting and synthesizing necessary reference pulses on the basis of digital input data and said reference pulses;

integrating the pulse string to output a voltage for gamma correction; and outputting a logical sum between a carry output from an adder circuit, which has as its inputs high order W bits of the digital input data of n bits and low order W bits of a binary counter, and a logical product between outputs X(m−1) through X(0) of said pulse generation circuit where m=n−W and the digital input data D(m−1) through D(0).

18. The method according to claim 17, further comprises the step of using the output analog voltage for a reference voltage for gamma correction in a source driver of a liquid crystal display.

* * * * *